US006068066A

United States Patent [19]

Byrt et al.

[11] Patent Number: 6,068,066

[45] Date of Patent: May 30, 2000

[54] HYDRAULIC DRILLING RIG

[76] Inventors: Harry F. Byrt, 13808-85 Ave., Edmonton, Canada, T5R 3Y7; Dave McConnell, 4103-46 Street, Leduc, Canada, T9E 4Z2

[21] Appl. No.: 09/136,977

[22] Filed: Aug. 20, 1998

[51] Int. Cl.[7] ..... E21B 15/02; B66F 7/16

[52] U.S. Cl. ..... 173/4; 173/152; 173/159; 173/190; 173/213; 175/220; 245/93 R; 245/386; 245/399

[58] Field of Search ..... 173/213, 39, 193, 173/152, 141, 159, 150, 190, 42, 4; 175/52, 57, 85, 220; 254/93 R, 386, 394, 399

[56] References Cited

U.S. PATENT DOCUMENTS

| | | | |
|---|---|---|---|
| 2,797,066 | 6/1957 | Sewell | 173/213 |
| 3,722,603 | 3/1973 | Brown | 173/159 |
| 3,780,816 | 12/1973 | Arrington et al. | 173/39 |
| 4,315,552 | 2/1982 | Winsor | 173/152 |
| 4,558,748 | 12/1985 | Gergo et al. | 175/57 |
| 5,524,713 | 6/1996 | Lange | 173/213 |

*Primary Examiner*—Scott A. Smith
*Attorney, Agent, or Firm*—Bennett Jones

[57] ABSTRACT

A multi-purpose drilling rig has a movable pipe support cradle which moves horizontally to transfer drill pipe from a storage area to the well being drilled, and vice versa. The cradle travels along a roof platform supported by load-bearing hydraulic lifting rams. Raising or lowering the lifting rams raises or lowers the roof platform, along with the drill pipe suspended from the cradle. Structural towers stabilize the lifting rams against buckling and lateral loads. Supplementary lifting capacity is provided cradle-mounted roof rams having pistons which may extend downward from the cradle, with the drill pipe suspended from a yoke interconnecting the roof ram pistons. For offshore drilling, a control system senses fluctuations in rig elevation due to wave action, and automatically adjusts extends or retracts the rams as required to maintain constant load on the drill bit. Also disclosed is a method of drilling which utilizes vertical and lateral movement of the cradle and top drive.

16 Claims, 7 Drawing Sheets

HYDRAULIC DRILLING RIG

FIELD OF THE INVENTION

The present invention relates to drilling rigs, and in particular to rigs for drilling gas and oil wells, and rigs for servicing of existing wells. Even more particularly, the present invention relates to heavy-duty rigs for deep-water offshore drilling from drill ships or ocean-going drilling platforms.

BACKGROUND OF THE INVENTION

Drilling an oil or gas well involves two main operations: drilling and tripping. To commence the drilling procedure, a drill string terminating with a drill bit is positioned within a drilling rig and rotated such that the drill bit bores into the ground or into the seabed, in the case of offshore drilling, until it reaches a predetermined depth or penetrates a petroleum-bearing geological formation. The components of the drill string such as drill collars and drill pipe are threaded for interconnection. Depending on what type of drive system is being used, the uppermost length of drill pipe in the drill string is connected either to a kelly or to a top drive, both of which are further described hereinafter. As the drill bit advances and the top of the drill string approaches the working platform or drill floor of the drilling rig, additional lengths of drill pipe must be added to the drill string in order to advance the well further into the ground. This is accomplished by temporarily supporting the top of the drill string near the drill floor level (using devices called "slips"), disconnecting the kelly (or the top drive, as the case may be) from the top of the drill string, and then lifting a new section of drill pipe into position using the rig's elevating system and screwing it into the top of the drill string. The kelly (or the top drive) is then reconnected to the drill string, and drilling operations resume until it is again necessary to add drill pipe.

Perhaps the most common and well-known drive means for rotating a drill string is the rotary table, which is a rotating mechanism positioned on the drill floor, and which entails the use of a kelly, referred to previously. The kelly is essentially a heavy, four-sided or six-sided pipe, usually about 42 feet long or 57 feet long for offshore rigs. The rotary table has rotating bushings shaped to accommodate the kelly, plus roller bearings which allow the kelly to slide vertically through the bushings even as the rotary table is rotating. The kelly is suspended from the rig's main hoist, in conjunction with various accessories required for drilling operations (e.g., swivel, pipe elevators). With the kelly connected to the top of the drill string, the hoist lowers the drill string until the lower end of the kelly is positioned within the bushings of the rotary table. The rotary table is then activated, rotating both the kelly and the drill string connected to it, thereby turning the drill bit at the bottom of the drill string and advancing the well to a greater depth. The process of turning the drill bit to advance the hole is referred to as "making hole".

An increasingly common alternative to the rotary table is the top drive unit, which applies rotational drive at the top of the drill string, rather than at the drill floor as in the case of the rotary table. Top drive units are typically driven by either hydraulic or electric power. A significant advantage of the top drive is that a kelly is not required; instead, the drill string is connected directly to the top drive, as previously described. The top drive is supported by the rig's main hoist, and moves downward along with the drill string as drilling progresses. A rig using a top drive must provide some means for resisting or absorbing the torque generated by the top drive as it rotates the drill string, so that the top drive will be laterally and rotationally stable at all stages of drilling. This is typically accomplished by having the top drive travel along vertical guide rails built into the rig superstructure.

Tripping is a necessary but unproductive part of the overall drilling operation, and involves two basic procedures. The first procedure is extracting drill pipe from the well (referred to in the industry as "pulling out of hole" mode, or "POH"), and the second is replacing drill pipe in the well ("running in hole" mode, or "RIH"). Tripping may be necessary for several reasons, such as for replacement of worn drill bits, for recovery of damaged drill string components, or for installation of well casing.

In POH mode the kelly (if there is one) is removed temporarily, the drill string is connected to the pipe elevators, and the drill string is then pulled partially out of the hole as far as the hoisting mechanism and geometry of the drilling rig will permit. The drill string is then supported by the slips so that the section or sections of the drill pipe exposed above the drill floor may be disconnected or "broken out" and moved away from the well. The elevators then re-engage the top of the drill string so that more of the drill string may be pulled out of the hole. This process is repeated until the desired portion of the drill string has been extracted. The procedure for RIH mode is essentially the reverse of that for POH mode.

It is well known to use cable-and-winch mechanisms for hoisting and lowering the drill string and casing string during the drilling of gas and oil wells. In such mechanisms, a heavy wire-rope cable (or "drilling line") runs upward from a winch (or "drawworks") mounted at the drill floor, then is threaded through the sheaves of a "crown block" mounted high in the derrick or mast of the rig, and then down through the sheaves of a "travelling block", which moves vertically with the load being hoisted. The entire weight of the drill string, which can be several hundred tons, is transferred via the travelling block, drilling line, and crown block to the rig's derrick, which accordingly must be designed and built to withstand such loads.

A significant disadvantage of cable-and-winch rigs is that the drilling line will deteriorate eventually, entailing complete removal and replacement. This may have to be done several times during the drilling of a single deep well. Drilling line cable, being commonly as large as two inches in diameter, is expensive, and it is not unusual for a rig to require a drilling line as up to 1,500 feet long. Replacement of the drilling line due to wear accordingly entails a large direct expense. As well, the inspection, servicing, and replacement of drilling line typically results in a considerable loss of drilling time, and a corresponding increase in the overall cost of the drilling operation.

In hydraulic drilling rigs, hydraulic cylinders are used in various configurations to provide the required hoisting capability. Some hydraulic rigs also use cables and sheaves but have no winch; others eliminate the need for cables and sheaves altogether. A significant advantage of the latter arrangement is that vertical hoisting forces are not transferred to the mast, but rather are carried directly by the hydraulic cylinders. The mast therefore may be designed primarily for wind loads and other lateral stability forces only, and can be made much lighter and thus more economical than it might otherwise have been.

Whatever type of rig is being used, drilling operations require a convenient storage area for drill pipe that will be either added to or removed from the drill string during drilling or tripping. On many rigs, drill pipe is stored vertically, resting on the drill floor and held at the top in a rack known as a "fingerboard." This system requires a "derrickman" working on a "monkey board" high up in the rig, to manipulate the top of the drill pipe as it is moved in and out of the fingerboard. Other rigs use a "pipe tub", which is a sloping rack typically located adjacent to and extending below the drill floor. Drill ships and ocean-going drilling platforms often provide for vertical or near-vertical storage of drill pipe in a "Texas deck" located under the drill floor, with access being provided through a large opening in the drill floor.

When sections of drill pipe are being added during drilling, or in RIH mode during tripping, the pipe must be transported into position from the pipe storage area. The opposite applies in POH mode during tripping, when pipe removed from the drill string must be transported away from the well and then to the Texas deck. With most if not all known drilling rigs, these pipe-handling operations cannot be conveniently performed using the rig's main hoist, because the main hoist typically is centered over the well hole, and cannot be moved laterally. The pipe has to be moved laterally using either manual effort or auxiliary machinery.

Some rigs employ an auxiliary hoist to handle drill pipe. U.S. Pat. Re. No. 29,541, reissued to Russell on Feb. 21, 1978, discloses a drilling rig having a hydraulically-actuated primary hoist, plus an auxiliary hoist for pipe-handling purposes in conjunction with a fingerboard. U.S. Pat. No. 4,629,014, issued to Swisher et al. on Dec. 16, 1986, and U.S. Pat. No. 4,830,336, issued to Herabakka on May 16, 1989, provide further examples of rigs which use an auxiliary hoist in conjunction with a fingerboard. Numerous other auxiliary pipe-handling and racking systems are known in the art. These systems, however, like the Russell, Swisher, and Herabakka rigs, have a significant drawback in that they require each length of pipe to be handled twice and connected to two different hoisting mechanisms, during both drilling and tripping operations. Such double handling makes drilling operations more time-consuming and expensive.

It can readily be seen that the efficiency and economy of a well-drilling operation will increase as the amount of time and effort required for handling drill pipe is decreased. For this reason, it is desirable to maximize the length of drill pipe that a drilling rig can handle at one time during tripping or when adding pipe during drilling. Drill pipe is typically manufactured in 31-foot-long "joints." Many smaller drilling rigs are capable of handling only a single joint at a time. However, many known rigs are able to handle "stands" made up of two joints ("doubles," in industry parlance) or three joints ("triples"), and such rigs can provide significant operational cost savings over rigs that can handle only singles.

These rigs still have significant disadvantages, however. To accommodate doubles and triples, they must have taller masts. For instance, if the rig is to handle triples which are 93 feet long, the hoist must be able to rise 100 feet or more above the drill floor. The mast has to be even higher than that, particularly for a drawworks-type rig, in order to accommodate hoist machinery such as the crown block. Because of its increased height, the mast will obviously be heavier and therefore more expensive than a shorter mast, even though the maximum hoisting loads which the mast must be designed for might be the same in either case. A taller mast's weight and cost will be even further increased by the need to design it for increased wind loads resulting from the mast's larger lateral profile.

Tall, heavy rigs have particular drawbacks when used on ocean-going drill platforms or drill ships. Each floating platform or drill ship has its own particular total weight limit, made up of dead weight plus usable load capacity. Every extra pound of rig weight adds to the dead weight and reduces the usable load capacity correspondingly. Extra dead weight not only increases fuel costs for transportation, but also increases expenses for supply ships, which must make more frequent visits because the platform or drill ship has less available load capacity for storage of supplies. Moreover, ocean-going rigs generally need to be even taller than comparable land-based rigs, because they must be able to accommodate or compensate for vertical heave of up to 15 feet or more, in order to keep the drill bit working at the bottom of the hole under an essentially constant vertical load when the platform or drill ship moves up or down due to wave action.

Another problem with tall rigs in an offshore drilling context is that the center of gravity of the rig, as well as that of the entire drilling platform or drill ship, generally rises higher above the water line as the mast becomes taller. This is especially true for rigs which have heavy hoisting equipment mounted high in the mast. When seas are calm, a high center of gravity will not have a major practical effect on rig operations. In stormy conditions with high seas, however, drilling and tripping operations can become impractical or unsafe or both because of the risk of listing or even overturning. This risk increases as the rig's center of gravity rises, so a tall rig generally will have to be shut down to wait out bad weather sooner than a shorter rig would have to be shut down in the same weather.

Downtime due to weather conditions, known as "waiting on weather" time (or "WOW" time) in offshore drilling parlance, is extremely expensive. Experience in North Sea drilling operations has been that WOW time averages as much as 10% of total rig deployment time. Because the total expense of operating an offshore rig is commonly in the range of $150,000 or more per day, it is readily apparent that the pipe-handling economies made possible by offshore rigs with tall masts can be offset significantly by a corresponding risk of increased WOW time.

For all the reasons outlined above, there is a need in the well-drilling industry for a drilling rig:

(a) which is capable of handling up to triple stands of drill pipe during both drilling and tripping operations;

(b) which can transport drill pipe to and from a pipe storage area using the rig's primary hoist, so as to eliminate or minimize the need for hoisting or otherwise manipulating drill pipe using auxiliary equipment or manual labour;

(c) which does not require drill line, sheaves, or drawworks;

(d) which does not transfer vertical hoisting loads to the rig superstructure;

(e) which provides integral means for heave compensation, so as to be usable for offshore drilling operations;

(f) which may be conveniently and selectively reconfigured so as to adjust the elevation of the rig's center of gravity, thereby enhancing the rig's stability when being used in offshore drilling operations; and (g) which is significantly lighter in weight than known rigs capable of operating with triple stands of drill pipe.

SUMMARY OF THE INVENTION

In general terms, the invention is a drilling rig in which an upper platform, or roof platform, carries a track-mounted cradle adapted to support a drill string and associated components and drilling equipment. The roof platform may be lifted above a drill floor by hydraulically actuated lifting rams, and the cradle may be moved horizontally to facilitate the handling of drill pipe during drilling and tripping operations. Structural towers provide resistance to lateral loads, while vertical loads from the weight of the drill string are carried by the lifting rams.

The invention also comprises a service rig having all of the same structural elements of the drilling rig described above. Service rigs typically are used to install and/or pull out tubing from a well bore. The nature of that use typically does not require as large a scale of construction as a drilling rig. Therefore, service rigs may be constructed on a less robust scale.

Therefore, in one aspect of the invention, the drilling or service rig comprises:

(a) a rig substructure comprising a drill floor having a drill opening;

(b) at least three structural towers fixedly mounted to the rig substructure and projecting vertically above the drill floor, said towers being in spaced relationship to each other and encircling the drill opening;

(c) a plurality of hydraulically-actuated, telescoping lifting rams corresponding in number to the number of towers, said lifting rams being fixedly mounted at their lower ends to the rig substructure and projecting vertically above the drill floor, and each lifting ram being in proximal association with one of the towers;

(d) lateral support means associated with the towers for providing lateral support to the lifting rams throughout their range of telescoping operation;

(e) hydraulic power means for actuating the lifting rams such that the lifting rams may operate substantially in unison;

(f) a roof platform affixed to and supported by the upper ends of the lifting rams, said roof platform comprising a substantially horizontal cradle track;

(g) a cradle having means for engaging the cradle track such that the cradle may be mounted to and moved along the cradle track;

(h) cradle actuation means mounted to the roof platform, for moving the cradle along the cradle track; and (i) a drilling hook associated with the cradle, for vertically supporting a drill string plus accessory components and pipe-handling tools or service equipment.

In the preferred embodiment, the invention is a drilling rig and incorporates heave compensation means, primarily intended for applications of the invention for offshore drilling from floating platforms or drill ships, to keep the drill bit boring into subsurface formations under a desired constant vertical load notwithstanding any vertical heave of the floating platform or drill ship due to wave action. This is accomplished in the preferred embodiment by operation of the lifting rams in co-operation with hydraulically actuated roof rams mounted vertically to the cradle such that the pistons of the roof rams telescope downward below the cradle. The lower ends of the roof ram pistons are interconnected by a yoke to ensure that these pistons move together at all times. Heave compensation may also be accomplished, however, using the lifting rams alone, without the need for roof rams.

In the preferred embodiment, the drill string is suspended from the yoke, with the effect that extension or retraction of the roof ram pistons will lower or raise the drill string. A load cell associated with the yoke senses fluctuations in the load acting downward on the drill string, and communicates nearly instantaneously with the invention's hydraulic system to call for corresponding adjustments in hydraulic pressure being delivered to the lifting rams and roof rams, such that the lifting ram pistons and roof ram pistons will be retracted or extended as appropriate to maintain a desired vertical load on the drill bit.

In the preferred embodiment of the invention, there is the same number of roof rams as lifting rams, and each roof ram is paired with a corresponding lifting ram, with both rams in each such pair of rams being operated from a common hydraulic sub-system. In other words, the preferred embodiment will have multiple hydraulic sub-systems corresponding in number to the number of lifting ram/roof ram pairings. Each hydraulic sub-system is configured such that when it is not pressurized, the lifting rams will be fully retracted and the roof rams will be fully extended. As the hydraulic sub-systems are pressurized, the roof rams will retract before the lifting rams begin to extend. Conversely, when the system has been fully pressurized and the yoke is at its highest possible elevation, the lifting rams will be fully extended with the roof rams fully retracted, and as hydraulic pressure in the system is reduced the lifting rams will retract fully before the roof rams begin to extend.

In one embodiment, the drilling rig of the present invention is adapted for use with a rotary table mounted in the drill floor to rotate the drill string during drilling operations in conjunction with a kelly. In the preferred embodiment, however, the invention is adapted for use with a rotary top drive suspended from the yoke, thus making a rotary table and kelly unnecessary.

In the preferred embodiment of the invention, a torsion frame with a vertical torque track is suspended from the cradle, to stabilize both the yoke and the rotary top drive, and in particular to provide structural resistance to torque generated by the rotary top drive. Both the yoke and the rotary top drive engage the torque track so as to travel vertically along the torque track as the roof rams are extended or retracted, with the engagement of the rotary top drive to the torque track being such that torque may be transferred from the rotary top drive through the torsion frame to the cradle, which in turn transfers the torque through the roof platform to the towers.

In one alternative embodiment, the invention will be adapted for use with a rotary top drive but will not have heave compensation means. In that case, the rotary top drive may be rigidly mounted to the cradle such that torque from the rotary top drive will be transferred directly into the cradle without the need for a torsion frame. This alternative embodiment may have particular application for drilling wells on land; i.e., where there is no requirement to compensate for heave.

In one embodiment of the invention, the towers will be freestanding and of a fixed height generally corresponding to the maximum height to which it is desired to be able to raise the roof platform. Structural cross-bracing may be provided between two or more of the towers to enhance the towers' stability and rigidity. In embodiments featuring fixed-height towers, each lifting ram will be located close to one of the towers, and lateral support means associated with the towers may be deployed such that the lifting rams are structurally stabilized by the towers throughout their range of telescoping operation.

In the preferred embodiment of the invention, each tower has a stationary section plus a telescoping section inside the stationary section, with each lifting ram being positioned inside its corresponding tower. The upper end of each telescoping section is connected to the upper end of the corresponding lifting ram, such that activation of the lifting rams will cause the telescoping sections of the towers to rise out of or retract within the stationary sections. Each telescoping section co-operates structurally in all positions with its corresponding stationary section such that each tower is capable of resisting lateral forces acting thereon.

More preferably, the telescoping sections will be of such length that they may extend below the drill floor within the rig substructure when they are lowered. The stationary sections of the masts may therefore be made shorter in height, for a given roof platform travel range, than would be required if the telescoping sections did not extend below the drill floor.

The lifting rams may comprise single-acting or double-acting hydraulic cylinders, but the precise configuration of the lifting rams is not critical to the concept or function of the invention.

In another aspect of the invention, the invention is a method of drilling comprising the steps of:

(a) providing a drill rig comprising a drill floor with a drill opening, a drill pipe storage area associated with the drill rig, and a rotary top drive movable vertically and horizontally;

(b) supporting a drill string positioned in the drill opening, and disconnecting the top drive from the drill string;

(c) raising the top drive clear of the drill string;

(d) moving the top drive laterally from a position over the drill opening to a position over the drill pipe storage area;

(e) lowering the top drive and connecting the top drive to a drill pipe section from the drill pipe storage area;

(f) raising the top drive such that the bottom of the drill pipe section is higher than the top of the drill string;

(g) moving the top drive laterally to a position over the drill string;

(h) connecting the drill pipe section to the top of the drill string; and (i) recommencing drilling operations.

BRIEF DESCRIPTION OF THE DRAWINGS

Embodiments of the invention will now be described with reference to the accompanying drawings, in which numerical references denote like parts referred to herein, and in which.

DETAILED DESCRIPTION OF THE PREFERRED EMBODIMENT

Figure 1:
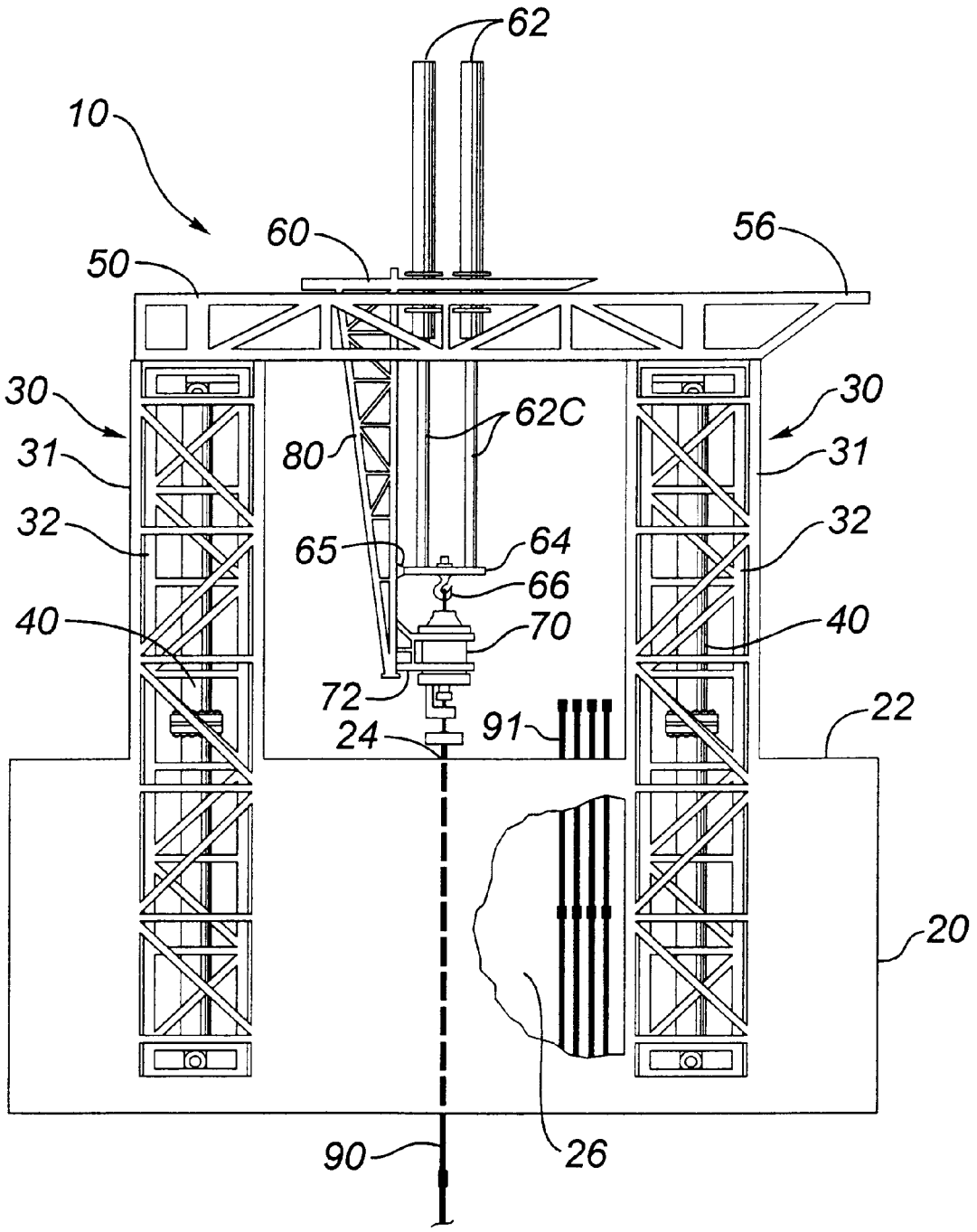
FIG. 1 is an elevational view of the preferred embodiment of the invention, showing the top drive at its lowest position above the drill floor and centered over the drill opening, with the lifting rams fully retracted and the roof rams fully extended.

Referring to the Figures, the preferred embodiment of the present invention is a drilling rig, generally denoted by reference numeral (10), having a substructure (20) and a drill floor (22). The construction of the drilling rig and its operation may be conveniently adapted to the construction and operation of a service rig by a person skilled in the art. It is intended that the appended claims also encompass service rigs comprising the relevant elements described herein.

Drill floor (22) has a drill opening (24) for passage of a string of drilling pipe, or drill string (90), downward through the substructure (20). Substructure (20) may be erected on land, or alternatively may form part of a drill ship or an ocean-going drilling platform. In the preferred embodiment, the substructure (20) will incorporate a Texas deck (26) for storage of drill pipe.

Figure 6:
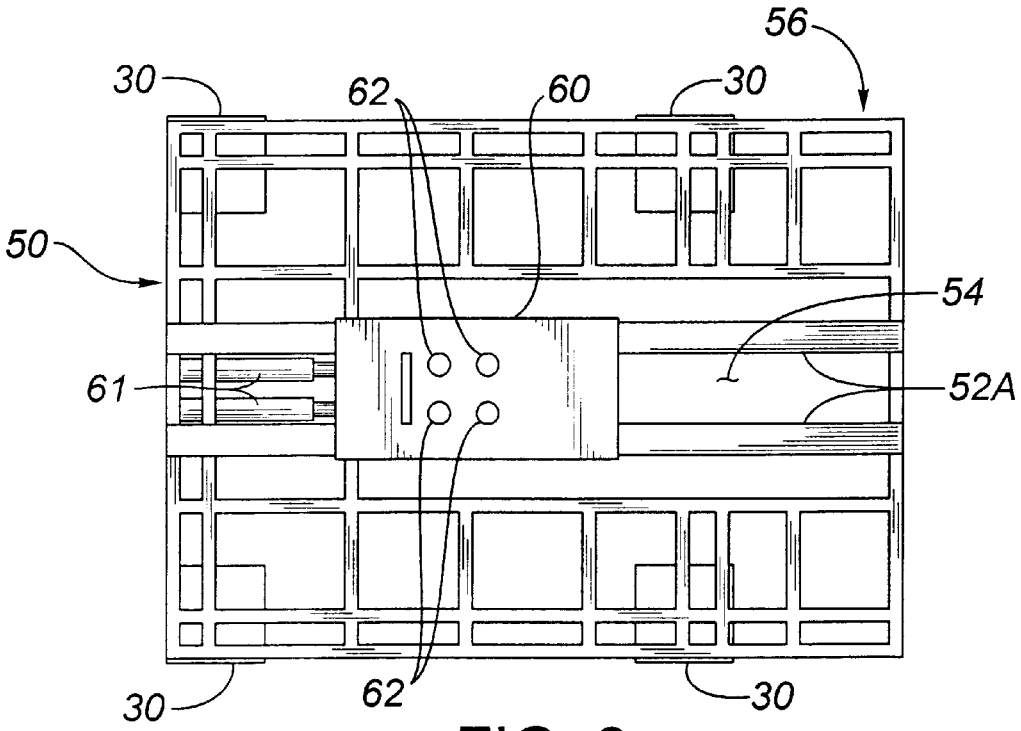
FIG. 6 is a plan view of the upper platform of the preferred embodiment of the invention, showing the cradle positioned such that the top drive is centered over the drill opening.
Figure 7:
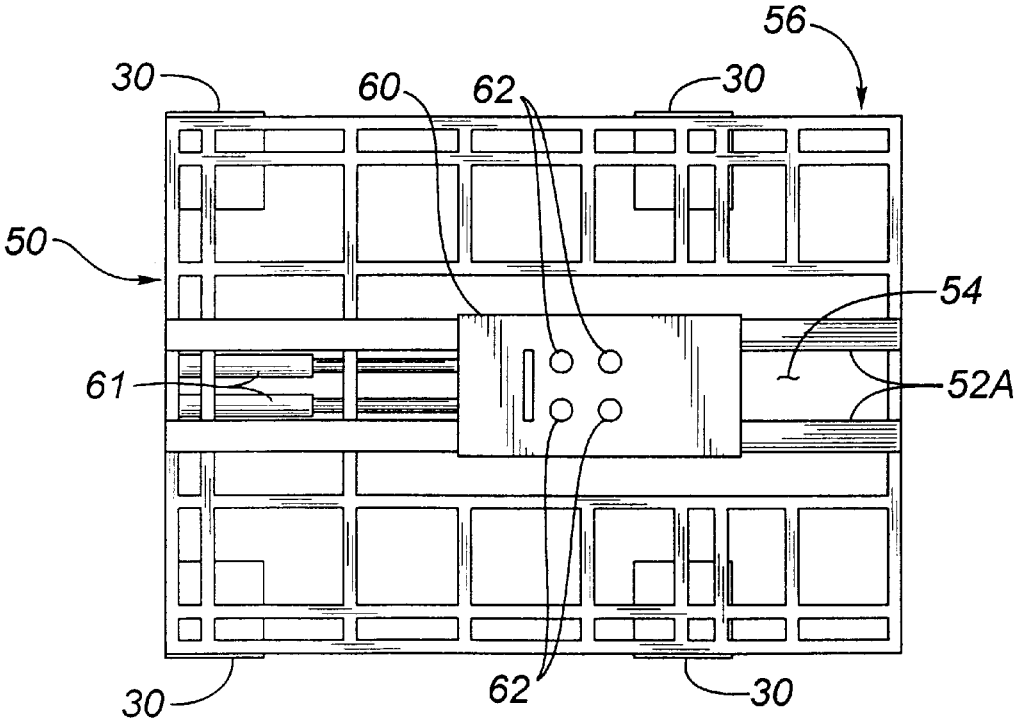
FIG. 7 is a plan view of the upper platform of the preferred embodiment of the invention, showing the cradle positioned such that the top drive is shifted horizontally away from the centerline of the drill opening.

The drilling rig also has a number of structural towers (30) rigidly anchored to the substructure (20), spaced apart from each other, and projecting vertically above the drill floor (22). The primary function of the towers (30) is to provide structural resistance to lateral loads such as wind, and they are not required to carry significant vertical loads other than their dead weight. The preferred embodiment comprises four towers (30) located so as to form the corners of a square or a rectangle when viewed in plan, as illustrated in FIGS. 6 and 7. However, it is conceptually possible for the invention to have as few as three and perhaps more than four towers (30), arranged in any of a variety of configurations.

The drilling rig also has a number of hydraulically-actuated lifting rams (40). In the preferred embodiment, the number of lifting rams (40) corresponds to the number of towers (30). The lifting rams (40) are anchored to the substructure (20) at or below the drill floor (22) such that they extend vertically above the drill floor (22). As will be explained in greater detail hereinafter, the lifting rams (40) provide the hoisting capacity required to support the drill string (90) during drilling of a well, or to pull the drill string (90) out of the well during tripping operations. Accordingly, the lifting rams (40) require sufficient structural capacity to carry the total weight of the drill string (90), plus the weight of drilling accessories and other drilling rig components referred to later herein.

Each lifting ram (40) is positioned in close proximity to a particular one of the towers (30) so that the towers (30) may be conveniently used to stabilize the lifting rams (40)

against lateral loads, and to brace the lifting rams (40) against lateral buckling when carrying heavy compression loads from the weight of the drill string (90). Accordingly, lateral support means (not shown) will be provided to brace each lifting ram (40) back to its corresponding tower (30) at desired positions.

In the preferred embodiment of the invention, the lateral support means associated with each tower (30) and lifting ram (40) combination will comprise a number of roller wheels having horizontal rotational axes. Three or more roller wheels are provided for each position at which bracing for the lifting ram (40) is desired, with the positions of the roller wheels being angularly separated around the perimeter of the lifting ram (40). The roller wheels are mounted to the tower (30) using scissor-action mechanisms or other suitable mechanisms which will allow each roller wheel to be retracted to a first position adjacent to the framework of the tower (30), and then to be extended horizontally, and perpendicularly to the roller wheel's rotational axis, to a second position at which the roller wheel is in firm contact with the lifting ram (40). When all of the roller wheels at a particular bracing point are in their second positions in contact with the lifting ram (40), they will co-operate to brace the lifting ram (40) and to transfer to the tower (30) any lateral stability forces which may be action on the lifting ram (40). When the lifting ram (40) is being actuated, the roller wheels will rotate, while remaining in firm contact with the lifting ram (40) even as it moves vertically relative to the roller wheels. The roller wheels thus are able to provide continuously effective lateral bracing to the lifting ram (40) at all times.

In the preferred embodiment, roller wheel control means (not shown) will be provided to control the position of the roller wheels. The roller wheel control means may comprise a system of limit switches which will be tripped sequentially as the lifting rams (40) are actuated, signalling each set of roller wheels to be deployed into position in contact with its corresponding lifting ram (40) when the lifting ram (40) is in a selected configuration. Also in the preferred embodiment, the roller wheels of the lateral support means will be made of a durable and resilient material, such as a synthetic polymer, which may make resilient rolling contact against the lifting rams (40) without damaging the surface of the lifting rams (40).

Figure 2:
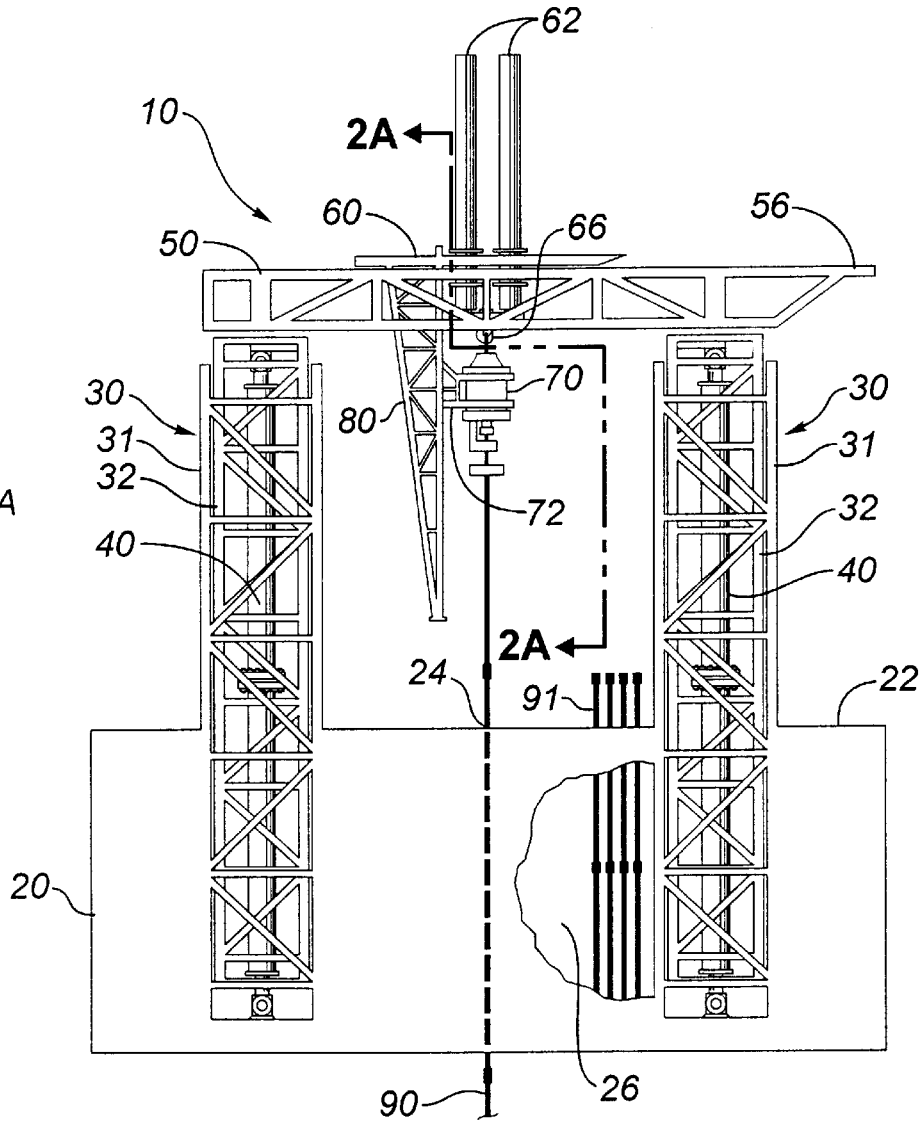
FIG. 2 is an elevational view of the preferred embodiment of the invention, showing the top drive partially elevated above the drill floor and centered over the drill opening, with the lifting rams and the roof rams fully retracted.
Figure 3:
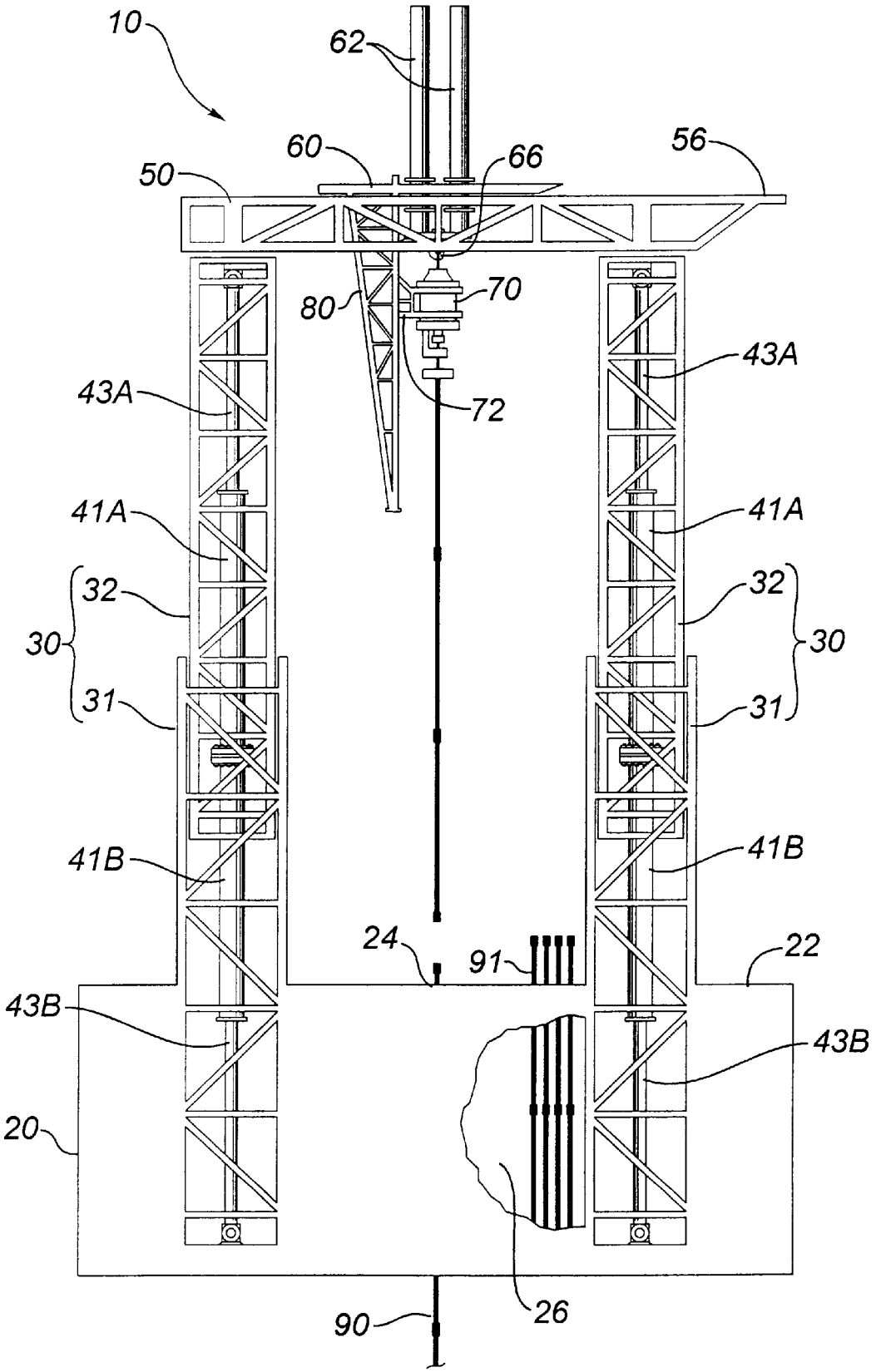
FIG. 3 is an elevational view of the preferred embodiment of the invention, showing the top drive at its highest position above the drill floor and centered over the drill opening, with the lifting rams fully extended and the roof rams fully retracted.
Figure 4:
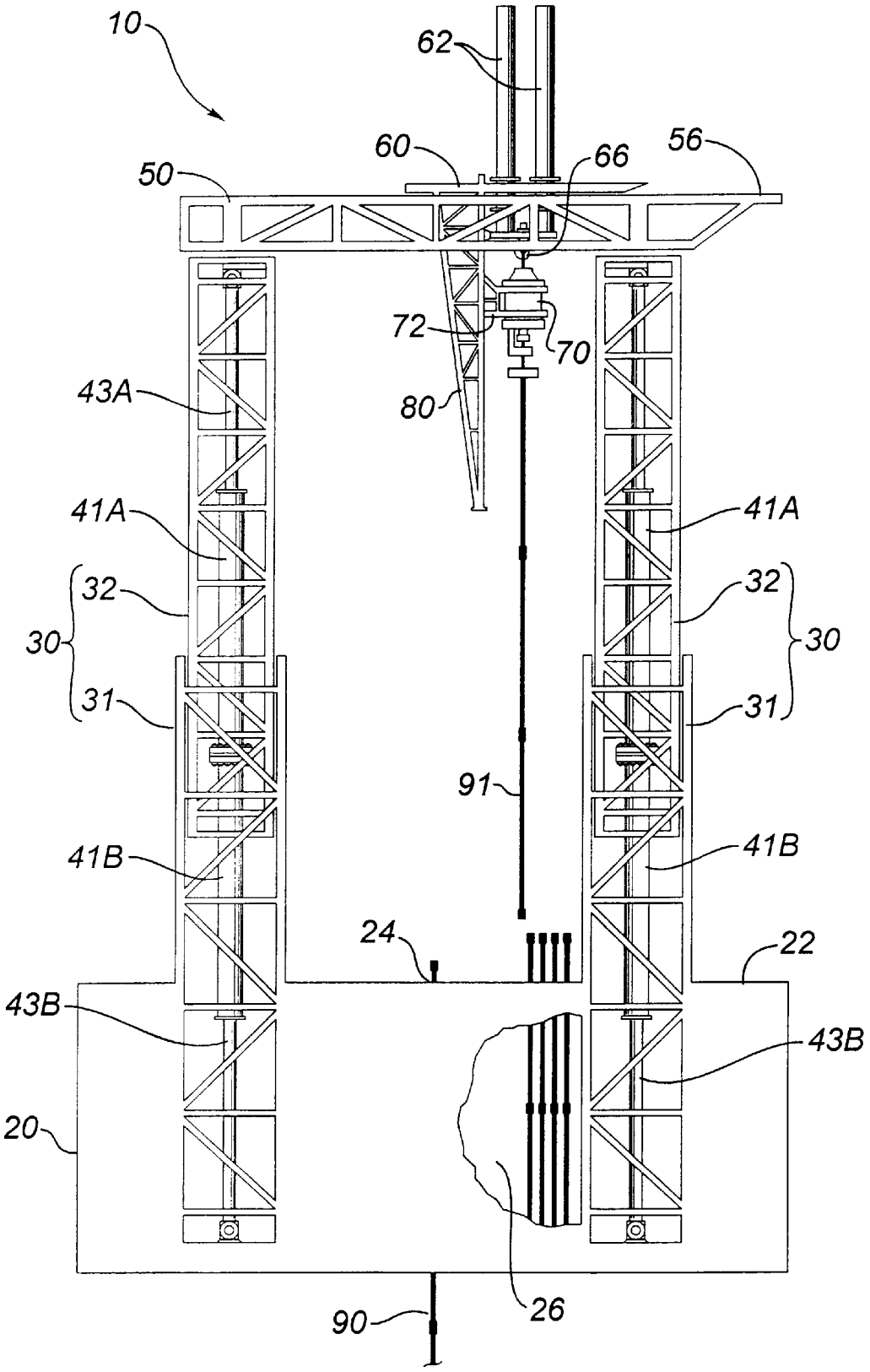
FIG. 4 is an elevational view of the preferred embodiment of the invention, showing the top drive at its highest position above the drill floor, but shifted horizontally away from the centerline of the drill opening.
Figure 8:
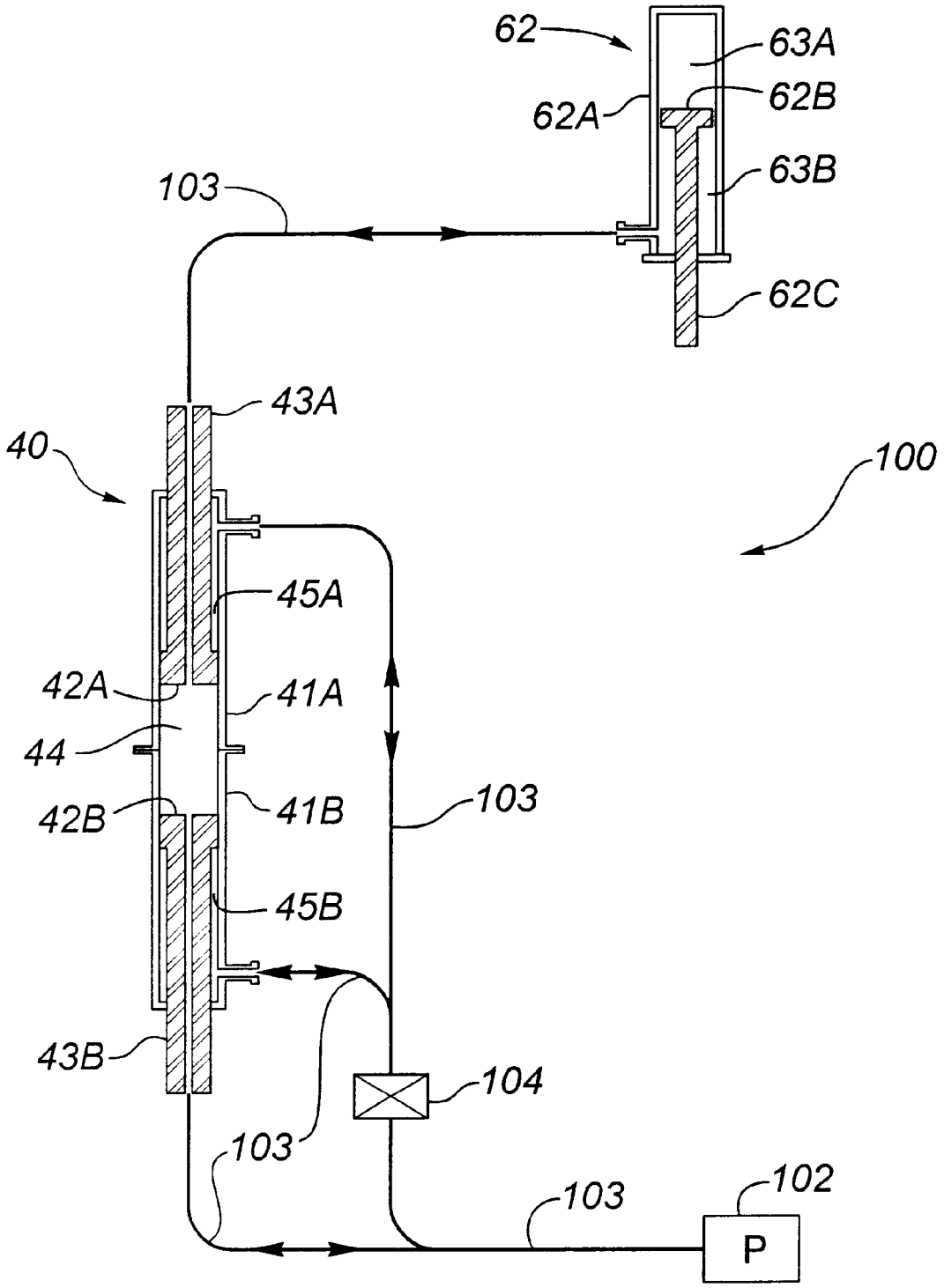
FIG. 8 is a schematic diagram of one of the hydraulic sub-systems of the preferred embodiment of the invention, for operating the lifting rams and roof rams.

As illustrated in FIGS. 3, 4, and 8, each lifting ram (40) includes a main cylinder (41) which in the preferred embodiment is formed by flanging together an upper cylinder (41*a*) and a lower cylinder (41*b*). Each lifting ram (40) further includes an upper piston (41*a*) and a lower piston (42*b*) which travel inside the upper cylinder (41*a*) and the lower cylinder (41*b*) respectively. Each piston (42*a* or 42*b*) is connected to a piston rod (43*a* or 43*b*), said piston rods each having a hollow longitudinal passage (not shown) for passage of hydraulic fluid. As illustrated in FIG. 8, each main cylinder (41) also comprises a main chamber (44) between the upper piston (42*a*) and the lower piston (42*b*), an upper annular chamber (45*a*) between the upper piston rod (43*a*) and the upper cylinder (41*a*), and a lower annular chamber (45*b*) between the lower piston rod (43*b*) and the lower cylinder (41*b*). Both the upper piston (42*a*) and the lower piston (42*b*) have vertical passages (not shown) coinciding with the longitudinal passages in the piston rods (43*a*, 43*b*), such that hydraulic fluid may pass through the pistons (42*a*, 42*b*) and the piston rods into the main chamber (44). The lower end of the lower piston rod (43*b*) is affixed to the substructure (20) while the upper end of the upper piston (43*a*) is connected to and supports a roof platform (50) which in turn supports a cradle (60), as indicated in FIGS. 1 through 5.

The towers (30) may be of a fixed length generally corresponding to the maximum extension of the lifting rams (40). However, in the preferred embodiment illustrated in FIGS. 1 through 5, the towers (30) will be of telescoping construction and operation, each tower (30) having a stationary section (31) anchored to the substructure (20), plus a telescoping section (32) which is positioned inside the stationary section (31) such that it may be retracted within the stationary section (31) and may telescope vertically above the stationary section (31). As shown in FIGS. 1 through 5, such telescopic movement of the towers (30) is provided for in the preferred embodiment by positioning the lifting rams (40) inside their corresponding towers (30) rather than adjacent thereto, and by connecting the upper ends of the lifting rams (40) to the uppers ends of their corresponding telescoping sections (32), so that extending or retracting the lifting rams (40) will effect a corresponding extension or retraction of the telescoping sections (32) and in turn will raise or lower the roof platform (50).

The roof platform (50) is mounted upon the upper ends of the lifting rams (40). In the preferred embodiment and as shown in FIGS. 1 through 7, the roof platform (50) is illustrated as being of trussed construction with a square or rectangular shape in plan. However, the shape and form of construction are not critical to the function of the roof platform (50). The roof platform (50) has a horizontal cradle track (52) comprising two cradle track rails (52*a*) which run parallel to each other as shown in FIGS. 6 and 7. Also as shown in FIGS. 6 and 7, the roof platform (50) has a platform opening (54) generally corresponding to the space between the cradle track rails (52*a*). In the preferred embodiment of the invention, and for purposes which will be explained hereinafter, the roof platform (50) has an optional cantilevered section (56) and the platform opening (54) extends into the cantilevered section (56), all as shown in FIGS. 1 through 7.

The cradle (60) is mounted on the cradle track (52), engaging the cradle track rails (52*a*) in such fashion that the cradle (50) may be rollingly or slidingly moved along the cradle track (52). Such movement of the cradle (60) is effected by cradle actuation means, which in the preferred embodiment is a pair of hydraulically-actuated cradle rams (61) mounted to the roof platform (50) as shown in FIGS. 6 and 7.

A drilling hook (66) is provided in association with the cradle (60), for supporting a drill string plus pipe-handling equipment such as a swivel and pipe elevators. In one embodiment, the invention will be adapted for use with a rotary table (not shown) mounted in the drill floor (22), in which embodiment the pipe-handling equipment supported by the drilling hook (66) will include a kelly (not shown). In the preferred embodiment, however, the invention will be adapted for use with a rotary top drive (70) suspended from the drilling hook (66). In embodiments of the invention which will accommodate a rotary top drive (70), the cradle (60) also comprises a torsion frame (80), to resist the considerable torque generated by the rotary top drive (70) as it rotates a drill string (90), thereby preventing unwanted rotational instability in the rotary top drive (70), and to transfer such torque to the towers (30).

For effective drilling, the drill bit (not shown) at the bottom of the drill string must exert a relatively constant force on the subsurface material which the drill bit is boring into. This is comparatively simple to accomplish when drilling on land. However, when drilling offshore wells from a drill ship or floating platform, wave action will cause vertical oscillation, or heave, of the drill ship or floating platform. For this reason, the preferred embodiment of the invention will have heave compensation means, which provide for vertical movement of the drilling rig relative to the drill string while maintaining a constant vertical load on the drill bit.

Figure 2A:
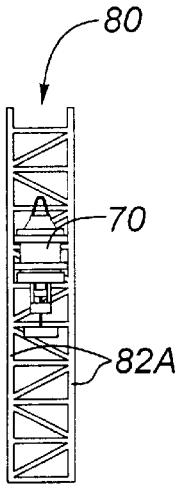
FIG. 2A is an elevational view of the top drive and torsion frame of the preferred embodiment of the invention.
Figure 5:
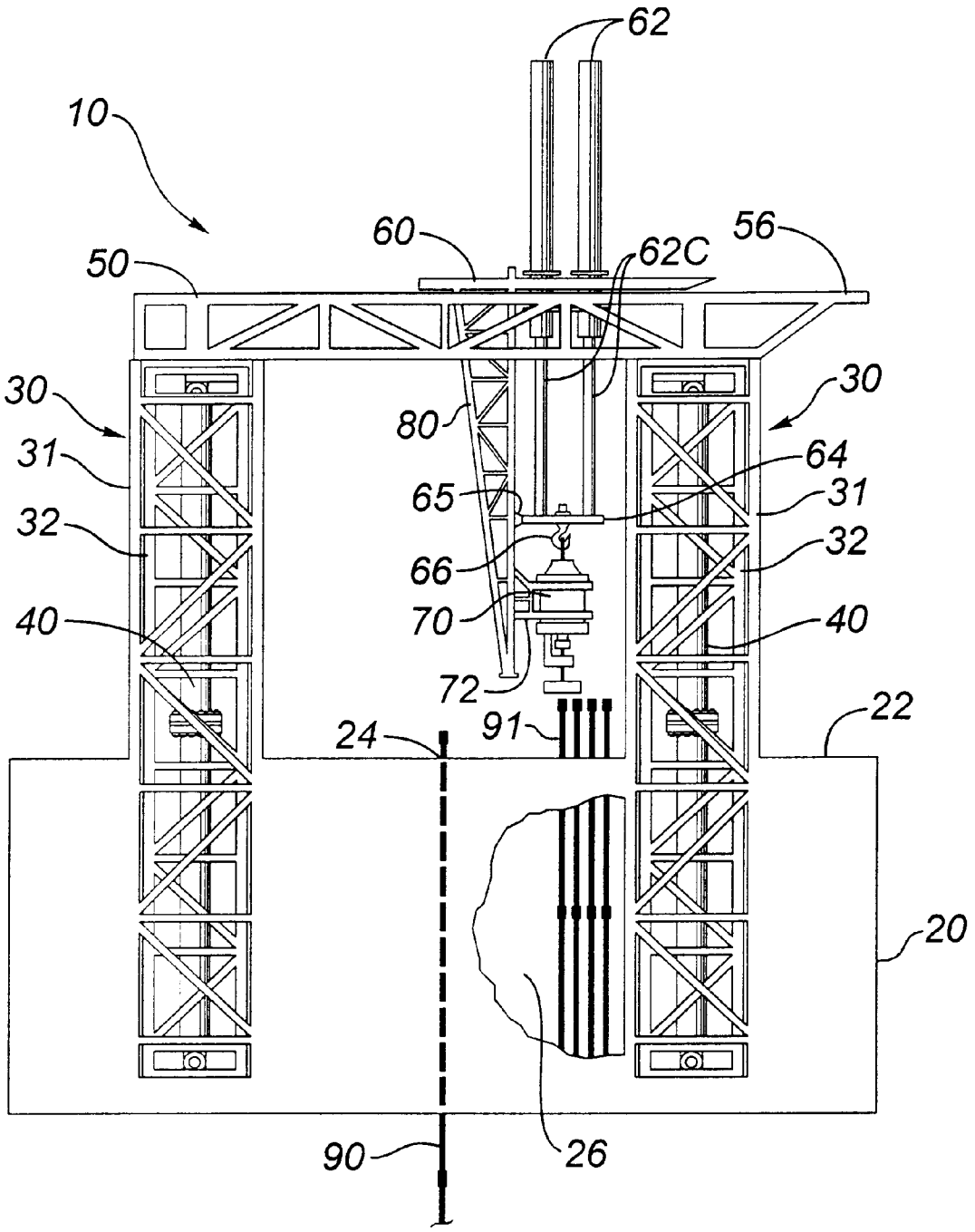
FIG. 5 is an elevational view of the preferred embodiment of the invention, showing the top drive at its lowest position above the drill floor, but shifted horizontally away from the centerline of the drill opening.

In the preferred embodiment of the invention, as illustrated in FIGS. 1 through 8, the heave compensation means comprises four hydraulic roof rams (62), each of which comprises a roof ram cylinder (62*a*), a roof ram piston (62*b*) which may travel vertically within the roof ram cylinder (62*a*), and a roof ram piston (62*c*). As illustrated in FIG. 8, each roof cylinder (62*a*) includes a primary chamber (63*a*) and an annular secondary chamber (63*b*). The roof rams (62) are mounted to the cradle (60) in substantially vertical orientation, such that the roof ram pistons (62*b*) extend downward below the cradle (60). A yoke (64) is provided to interconnect the lower ends of the roof ram pistons (62*b*) to ensure that the roof ram pistons (62*b*) will move in unison. In the preferred embodiment, the drilling hook (66) is connected to the yoke (64) as illustrated in FIGS. 1 and 5, and typically will be any of several types of heavy-duty drilling hook which are readily available from drilling equipment supply companies. The drill string (90) thus is effectively supported by the roof rams (62), which transfer the weight of the drill string (90) to the cradle (60).

It will be readily seen that the vertical position of the drill string (90) relative to the drill floor (22) and rig substructure (20) may be controlled by selectively extending or retracting the roof ram pistons (62*b*) as well as by controlling the position of the lifting rams (40). In the preferred embodiment, the invention will comprise control means, which may be a load cell (not shown) associated with the yoke (64), for sensing variations in the load being exerted on the drill bit, such as will occur when the absolute elevation of the rig substructure (20) changes due to wave action, and for electronically adjusting the hydraulic pressure being delivered to the lifting rams (40) and the roof rams (62) as necessary to maintain a relatively constant load on the drill bit.

Because of the configuration of the hydraulic power system used in the preferred embodiment, as will be described in further detail below, the lifting rams (40) may be used for heave compensation in addition to the roof rams (62). The roof rams (62) must be retracted (raised) fully before the lifting rams (40) will extend and, conversely, the lifting rams (40) must be fully retracted before the roof rams (62) will extend (lower). For example, if the control mechanism calls for the hydraulic system to lower the roof platform (50) while the roof rams (62) are fully retracted, the lifting rams (40) will retract first, lowering the drill string (90), and the roof rams (62) will begin to extend (lower) only after the lifting rams (40) are fully retracted. Conversely, if the control means calls for the drill string (90) to be lifted when the lifting rams (40) are fully retracted (lowered) and the roof rams (62) are extended, the roof rams (62) will retract first, raising the drill string (90), and the lifting rams (40) will begin to extend, raising the drill string (90) further, only after the roof rams (62) are fully retracted. Therefore, in the preferred embodiment, the lifting rams (40) and the roof rams (62) co-operate to constitute the heave compensation means.

The preferred embodiment of the invention thus will have roof rams (62) and will also be adapted for use with a rotary top drive (70) as illustrated in FIGS. 1 through 5. Accordingly, the torsion frame (80) of the preferred embodiment must be capable of performing its function regardless of the vertical position of the rotary top drive (70) as it moves with the roof rams (62). The torsion frame (80) is therefore rigidly connected to the cradle (60) and extends below the cradle (60) at least as far as it is possible for the rotary top drive (70) to be lowered below the cradle (60). The torsion frame (80) has a vertical torque track (82), preferably comprising a pair of torque track rails (82*a*) as generally illustrated in FIG. 2*a*. The rotary top drive (70) has a top drive brace (72) as the torque track engagement means which may slidingly or rollingly engage the torque track (82) such that the rotary top drive (70) may move vertically while being guided and rotationally restrained by the torque track rails (82*a*) and the torsion frame (80).

To enhance the overall lateral and rotational stability of the rotary top drive (70) and the roof ram pistons (62*b*), the yoke (64) of the preferred embodiment will have a yoke brace (65) which also slidingly or rollingly engages the torque track rails (82*a*) such that it may move vertically while being guided and rotationally restrained by the torsion frame (80).

Besides transferring torque to the towers (30), the yoke brace (65) and the top drive brace (72) also ensure that the top drive (70) and the yoke (64) remain aligned vertically with the roof rams (62) as the roof rams (62) move up and down.

The lifting rams (40) and the roof rams (62) are actuated hydraulically using conventional and well-known large-capacity hydraulic pumps and hydraulic control systems. In the preferred embodiment and as shown schematically in FIG. 8, each lifting ram (40) and its corresponding roof ram (62) are served by a dedicated hydraulic sub-system (100). Therefore, in the preferred embodiment with four lifting rams (40) and four roof rams (62), there are four hydraulic sub-systems (100), each comprising one or more hydraulic pumps (102) and and a pressure valve (104). As schematically depicted in FIG. 8, hydraulic fluid conduits (103) carry hydraulic fluid between the various components of the hydraulic sub-systems (100). The four hydraulic sub-systems (100) are coordinated by means of a control system (not shown) which ensures that the four lifting rams (40) lift and retract the roof platform (50) in unison.

The hydraulic pumps are preferably reversible pumps to speed up retraction of the lifting rams (42) and roof rams (62) to lower the roof platform (50).

In the preferred embodiment, the lifting rams (40) are double-acting, which means that hydraulic fluid is supplied not only to the main chamber (44) but also to the upper and lower annular chambers (45*a*, 45*b*). The pistons (42*a*, 42*b*) match the inside diameter of the cylinder (41) at 12" while the piston rods (43*a*, 43*b*) each have an outside diameter of 10". The main chamber (44) is open to the annular chambers (45*a*, 45*b*) such that the hydraulic pressure within them is always equal. However, the difference in surface area between the upper side and lower side of each piston (42*a* or 42*b*) causes the lifting rams (40) to react to changes in hydraulic pressure. By using double-acting lifting rams (40), the seals (not shown) of the pistons (42*a*, 42*b*) are always lubricated. Of course, the invention is not limited to double-acting rams, as single-acting rams are also suitable for use with the present invention.

Each individual lifting ram (40) is also hydraulically connected to a particular roof ram (62), with the main chamber (44) of each lifting ram (40) being in fluid communication with its corresponding roof ram cylinder (62*a*) through the hollow upper piston rod (43*a*) of the lifting ram (40). The roof rams (62) act oppositely to the lifting rams (40) in that retraction of the roof ram pistons (62*b*) into the roof ram cylinders (62*a*), so as to raise the top drive (70) and drill string (90), is effected by pressurizing the annular secondary chambers of the roof ram cylinders (62*a*), as shown in FIG. 8. In contrast, and also as shown in FIG. 8, retraction of the lifting ram pistons (42*a*, 42*b*) into the upper cylinders (41*a*) and the lower cylinders (41*b*) of the lifting rams (40) is effected by pressurizing the main chambers (44) of the main cylinders (41), not the annular chambers (45*a*, 45*b*) thereof.

In the preferred embodiment, the roof ram cylinders (62*a*) have an inside diameter of 12¾" and the roof ram piston rods (62*c*) have a diameter of 5". As such, the roof rams (62) will activate first when the hydraulic system is pressurized. Only when the roof rams (62) are fully retracted, raising the top drive (70), will the lifting rams (40) begin to extend and further raise the top drive (70). Conversely, when the hydraulic pumps (102) are reversed, the lifting rams (40) will retract first, thus lowering the top drive (70), and only after the lifting rams (40) are fully retracted will the roof rams (62) begin to extend, further lowering the top drive (70).

A method of use of the drilling rig according to the present invention is illustrated in FIGS. 1 to 5, which show in sequence a POH-mode tripping operation where a triple stand of drill pipe is extracted, broken out and stored in the Texas deck (26). In FIG. 1, the roof platform is lowered completely by retracting the lifting rams (40). The top of the drill string (90) is the engaged by pipe elevators (not shown) associated with the top drive (70). The cradle (60) is centred on the roof platform (50) such that the yoke (64) is centred over the drill opening (24).

In first part of the lifting phase of operation, as shown in FIG. 2, the roof rams are actuated to lift the top drive (70) to the top of the torsion frame, which lifts the drill string (90) a distance equal to the length of travel of the pistons within the roof rams (62). Next, the lifting rams (40) are actuated to lift the roof platform (50) which in turn lifts the drill string (90) out of the hole, as shown in FIG. 3. Because of the dimensions of the telescoping towers (30) and the lifting rams (40), a triple stand of drill pipe (91) may be completely lifted out of the hole. The triple (91) may then be broken out by conventional means while the drill string (90) is supported by slips (not shown) or other conventional means.

The cradle (60) is then moved laterally by the cradle rams (61) until the triple (91) is positioned over the Texas deck (26) as shown in FIG. 4. The lifting process is reversed to lower the triple (91) into the Texas deck (26). The hydraulic system is first actuated to reverse and retract the lifting rams (40) and second to extend and lower the roof rams until the triple (91) is placed in a storage position in the Texas deck (26), as shown in FIG. 5. The triple (91) is then disconnected and left in storage. The cradle (60) may then be returned, by means of the cradle rams (61), to its centered position over the drill opening (24) so that the next three sections of drill pipe may be engaged and pulled by repeating the method of the present invention.

It may be readily seen that the steps outlined above may be reversed for tripping in RIH mode, and similarly for making hole. A triple (or perhaps some other length of drill pipe) is lifted out of the Texas deck (26) as needed, and then moved laterally by the cradle (60) so that the bottom of the triple (91) may be connected to the top of the drill string (90) projecting above the drill opening (24). Drilling may then be continued by activating the top drive (70) so as to rotate the drill bit (not shown) into the subsurface formation being drilled. The top drive (70) and drill string (90) are lowered as drilling progresses, firstly by lowering (retraction) of the lifting rams (40), and secondly by lowering (extension) of the roof rams (62), until the drill bit has advanced the length of a triple (91). The lowering of the lifing rams (40) and the roof rams (62) may be controlled by the load cell and control system described above.

In the preferred embodiment, the roof platform (50) will have cantilevered section (56) as previously mentioned. It will be readily seen from FIGS. 6 and 7 and from the preceding description of the invention that the cradle (60) may be moved out to the end of the cantilevered section (56) such that the hoisting facility provided by the lifting rams (40) and the roof rams (62) may be used to lift items located outboard of the towers (40) on the same side of the rig as the cantilevered section (56). The cantilevered section (56) may advantageously extend beyond the sides of a drill ship or drilling platform on which the rig is mounted, such that the rig's hoisting capacity may be used to unload equipment or supplies from supply ships positioned adjacent to the drill ship or drilling platform.

The embodiments of the invention in which an exclusive property or privilege is claimed are as follows:

1. A drilling or service rig comprising:

(a) a rig substructure comprising a drill floor having a drill opening;

(b) at least three structural towers fixedly mounted to the rig substructure and projecting vertically above the drill floor, said towers being in spaced relationship to each other and encircling the drill opening;

(c) a plurality of hydraulically-actuated, telescoping lifting rams corresponding in number to the number of towers, said lifting rams being fixedly mounted at their lower ends to the rig substructure and projecting vertically above the drill floor, and each lifting ram being in proximal association with one of the towers;

(d) lateral support means associated with the towers for providing lateral support to the lifting rams throughout their range of telescoping operation;

(e) hydraulic power means for actuating the lifting rams such that the lifting rams may operate substantially in unison;

(f) a roof platform affixed to and supported by the upper ends of the lifting rams, said roof platform comprising a substantially horizontal cradle track;

(g) a cradle having means for engaging the cradle track such that the cradle may be mounted to and moved along the cradle track;

(h) cradle actuation means mounted to the roof platform, for moving the cradle along the cradle track; and (i) a drilling hook associated with the cradle, for vertically supporting a drill string plus accessory components and pipe-handling tools or service equipment.

2. The drilling rig of claim 1 wherein the cradle further comprises heave compensation means, for regulating the vertical position of a drill string in response to fluctuations in the elevation of the drilling rig.

3. The drilling rig of claim 2 wherein the heave compensation means comprises:

(a) a hydraulically-actuated, telescoping roof ram having a barrel and a piston, said roof ram being mounted to the cradle such that the piston of the roof ram may telescope vertically downward;

(b) a yoke rigidly connected to the lower end of the roof ram piston; and (c) hydraulic power means for actuating the roof ram; wherein the drilling hook is associated with said yoke.

4. The drilling rig of claim 3 wherein:

(a) the number of roof rams corresponds with the number of lifting rams;

(b) each roof ram is hydraulically connected to one of the lifting rams;

(c) the hydraulic power means comprises a plurality of hydraulic sub-systems corresponding in number to the number of lifting rams; and (d) each hydraulic sub-system is adapted to actuate one of the lifting rams and its associated roof ram.

5. The drilling rig of claim 4 wherein each hydraulic subsystem comprises at least one reversible hydraulic pump.

6. The drilling rig of claim 3 wherein the drill floor is adapted to accommodate a rotary table for purposes of rotating a drill string in association with a kelly.

7. The drilling rig of claim 3 wherein the drilling hook is adapted to accommodate a rotary top drive for purposes of rotating a drill string.

8. The drilling rig of claim 7 further comprising a torsion frame rigidly affixed to and projecting downward from the cradle, said torsion frame having a vertically-oriented torque track, and wherein the yoke further comprises a yoke brace engaging the torque track so as to permit vertical travel of the yoke along the torque track.

9. The drilling rig of claim 8 wherein the torque track is adapted for engagement by a rotary top drive so as to permit vertical travel of the rotary top drive along the torque track.

10. The drilling rig of claim 1, further comprising control means for actuating the hydraulic power means so as to maintain a desired downward force on a drill bit during drilling of a well.

11. The drilling rig of claim 10 wherein the control means includes a load cell which senses the downward force on the drill bit, and which communicates with pressure regulation means which in turn communicates with the hydraulic power means, for adjusting hydraulic pressures in response to variations in said downward force.

12. The drilling rig of claim 1 further comprising structural cross-bracing between the towers.

13. The drilling rig of claim 1 wherein:

(a) each tower comprises a stationary section rigidly affixed to the rig substructure, plus a telescoping section which movably engages the stationary section, such that the telescoping section may extend above the stationary section while co-operating with the stationary section throughout its range of extension so as to provide structural resistance to lateral forces acting on the tower;

(b) the lifting ram associated with each tower is positioned inside the structure of the tower; and (c) the upper end of each telescoping section is connected to the upper end of its corresponding lifting ram, so as to travel concurrently therewith.

14. The drilling rig of claim 13 wherein the telescoping section is longer than the stationary section and may extend below the drilling floor into the rig substructure when lowered inside the stationary section.

15. The drilling rig of claim 1 wherein each lifting ram comprises a hydraulic cylinder having a lower portion and an upper portion, a lower piston which may telescope downward from the lower portion of the cylinder and an upper piston which may telescope upward from the upper portion.

16. The drilling rig of claim 15 wherein each lifting ram is double-acting.

* * * * *